United States Patent [19]

Ashworth, Jr.

[11] Patent Number: 4,618,141

[45] Date of Patent: Oct. 21, 1986

[54] THERAPEUTIC EXERCISE DEVICE

[76] Inventor: Thomas Ashworth, Jr., 2145 Maplewood Rd., Stow, Ohio 44224

[21] Appl. No.: 722,603

[22] Filed: Apr. 12, 1985

[51] Int. Cl.[4] ..... A63B 23/04

[52] U.S. Cl. ..... 272/73

[58] Field of Search ..... 272/73, 132; 128/25 R; 74/421 R, 812

[56] References Cited

U.S. PATENT DOCUMENTS

| | | | |
|---|---|---|---|
| 3,017,180 | 1/1962 | Aronsohn | 272/73 |
| 3,213,852 | 10/1965 | Zent | 128/25 R |
| 3,759,512 | 9/1973 | Yount et al. | 272/73 |
| 3,833,216 | 9/1974 | Philbin | 272/73 |
| 3,966,201 | 6/1976 | Mester | 272/73 |
| 4,475,872 | 10/1984 | Foughty | 74/812 |

FOREIGN PATENT DOCUMENTS

| | | | |
|---|---|---|---|
| 964160 | 7/1964 | United Kingdom | 128/25 R |

*Primary Examiner*—Richard J. Apley
*Assistant Examiner*—S. R. Crow
*Attorney, Agent, or Firm*—Oldham, Oldham & Weber Co.

[57] ABSTRACT

A therapeutic exercise device mounted on a floor base having a bicycle type seat, hand cranks and foot pedals.

The foot pedals turn a lower rotatable shaft equipped with a pair of identical sprockets.

Each hand crank turns a rotatably interconnected portion of a split upper shaft, each of said split shaft portions equipped with a sprocket. The sprocket on one split shaft portion is slightly larger than a lower shaft sprocket, and the sprocket on the other split shaft portion is slightly smaller than a lower shaft sprocket. A pair of drive chains interconnect the upper and lower sprockets.

4 Claims, 5 Drawing Figures

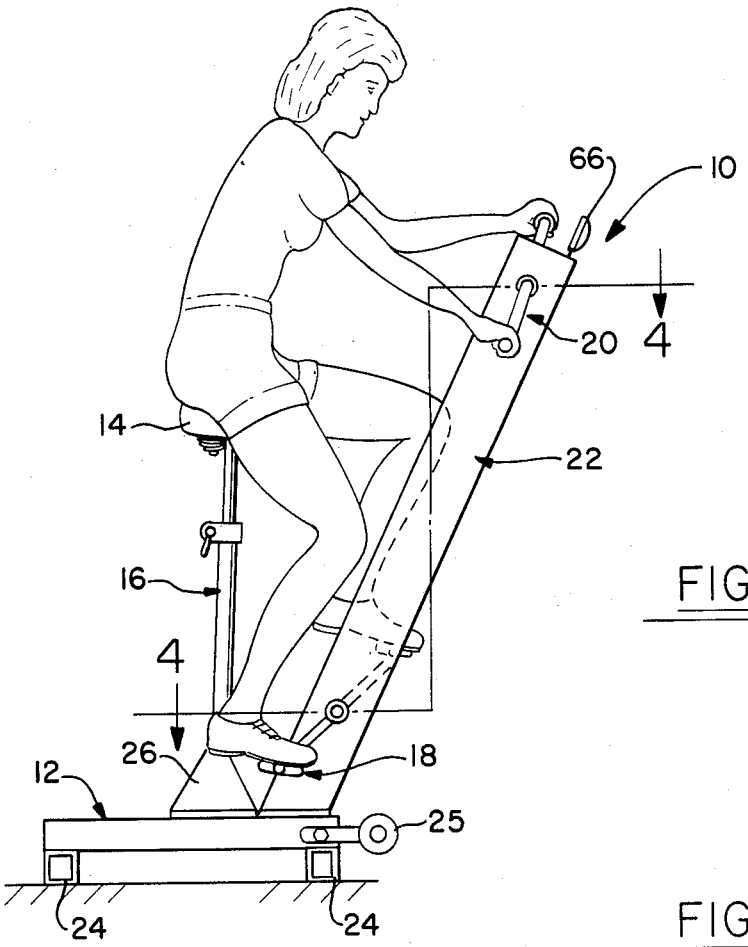
FIG.-1
FIG.-3
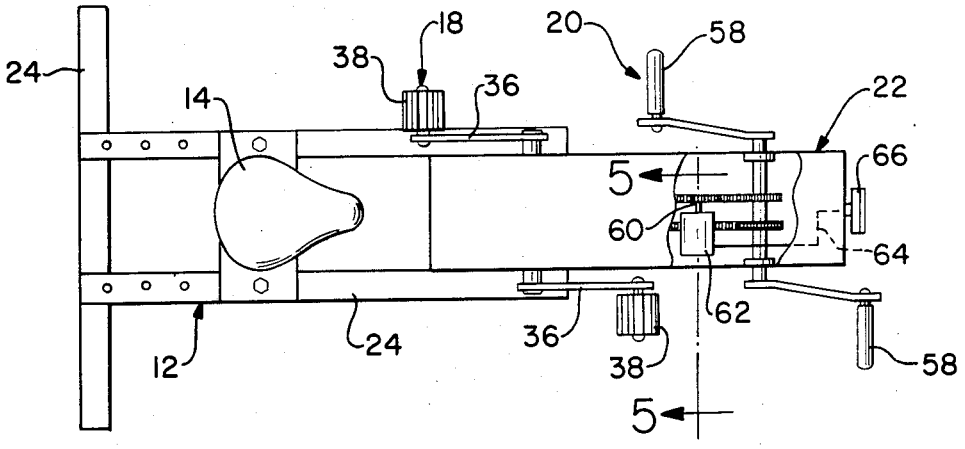

THERAPEUTIC EXERCISE DEVICE

TECHNICAL FIELD

The present invention relates to exercise equipment, more particularly to an exercise cycle type device having a seat, hand cranks and foot cranks.

BACKGROUND ART

There have been many types of exercise devices developed in the past for exercising the human body. The therapeutic benefits of vigorous exercise has been well established for everyone from athletes in prime condition to those suffering paralysis or debilitating disease. There have been many devices of the exercise cycle type employing the use of a stand of some type, a seat, foot pedals, and in some instances, handlebars or hand cranks.

Some fifteen (15) prior U.S. patents have been found on a patent search relating to the present invention. These prior art patents are listed as follows: 1,059,172; 1,344,963; 2,252,868; 2,783,044; 2,921,791; 3,017,180; 3,058,742; 3,213,852; 3,216,722; 3,572,699; 3,727,913; 3,759,512; 3,930,495; 3,966,201; and 4,188,030. None of the exercise devices shown by the above U.S. patents provide the user with the desired movement of the present invention wherein the legs operate together in a normal bicycle pedaling movement and wherein the arms operate in a consistantly varying cycle relative to the legs and each other.

DISCLOSURE OF INVENTION

It is therefore an object of the present invention to provide a therapeutic exercise device having uniform leg movement and varying arm movement.

It is the object of this invention to provide a device for rhythmic exercise of the human body and simultaneously exercise the legs to one rotational rhythm, one arm to another and the other arm to yet another.

It is a further object of this invention that the three rotational rhythms are corresponding and balanced with the legs rotating to a common rhythm, one arm slightly faster and one arm slightly slower.

It is an object of this invention that the said device be fun, simple, easy and relaxing to use and that it be of relatively simple construction, low cost and that it be reliable and easily maintained.

A further object of this invention is that the device be adaptable for safe and easy use by most any person.

According to the present invention, there is provided a therapeutic exercise device of the type having a base, a raised seat connected to the base, and a pair of hand cranks and a pair of foot cranks rotatably mounted on support means connected to the base, and comprising: a shaft, a pair of sprockets mounted on said shaft, said foot cranks being operably connected to said shaft, a separate shaft for each handcrank, each carrying a single sprocket, said handcrank shaft sprockets being of different diameters; and a drive means interconnnecting each handcrank sprocket to one of the pair of sprockets on foot pedal shafts.

The essential features of the invention and further optional features are described in detail in the following passages of the specification which refer to the accompanying drawings. The drawings, however, are merely illustrative of how the invention might be put into effect so that the specific form and arrangement of the features (whether they be essential or optional features) shown is not to be understood as limiting on the invention.

BRIEF DESCRIPTION OF THE DRAWINGS

For a better understanding of the invention, reference should be had to the accompanying drawings, wherein:

FIG. 1 is a perspective view of a therapeutic exercise device of the present invention;

FIG. 3 is a top view of the device;

BEST MODE FOR CARRYING OUT THE INVENTION

Figure 2:
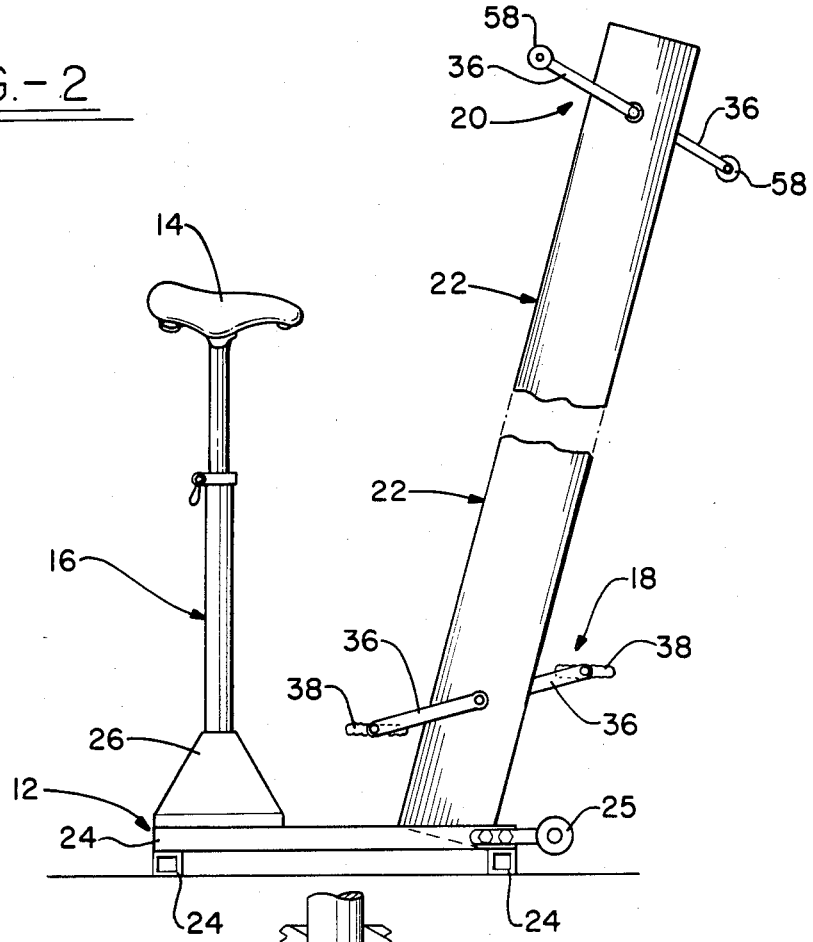
FIG. 2 is a side view of the device.

The therapeutic exercise device of the present invention, designated generally as 10 in FIG. 1, is a floor-mounted and cycle type exerciser equipped with base 12 and bicycle type seat 14 adjustable mounted on a post 16, connected to the base.

The device is equipped with pedals 18 and hand cranks 20, rotatably mounted in a column 22.

As shown in more detail in FIGS. 2 and 3, the base 12 is comprised of square tubular members 24, formed into a rectangular frame for placement on a flat surface, such as a floor. A small pair of caster type wheels 25 are mounted at the forward end for facilitating easier movement of the device across the floor by tipping it in a direction towards the wheels to slightly raise the base from the floor surface.

The seat post 16 is supported in the base 12 by triangular-shaped support plates 26, connecting said posts to the square tubular framework of the base 12. Note that the seat 14 is adjustably telescopically fitted to the post 16 to be raised or lowered to best suit the size of the individual using the device.

Figure 4:
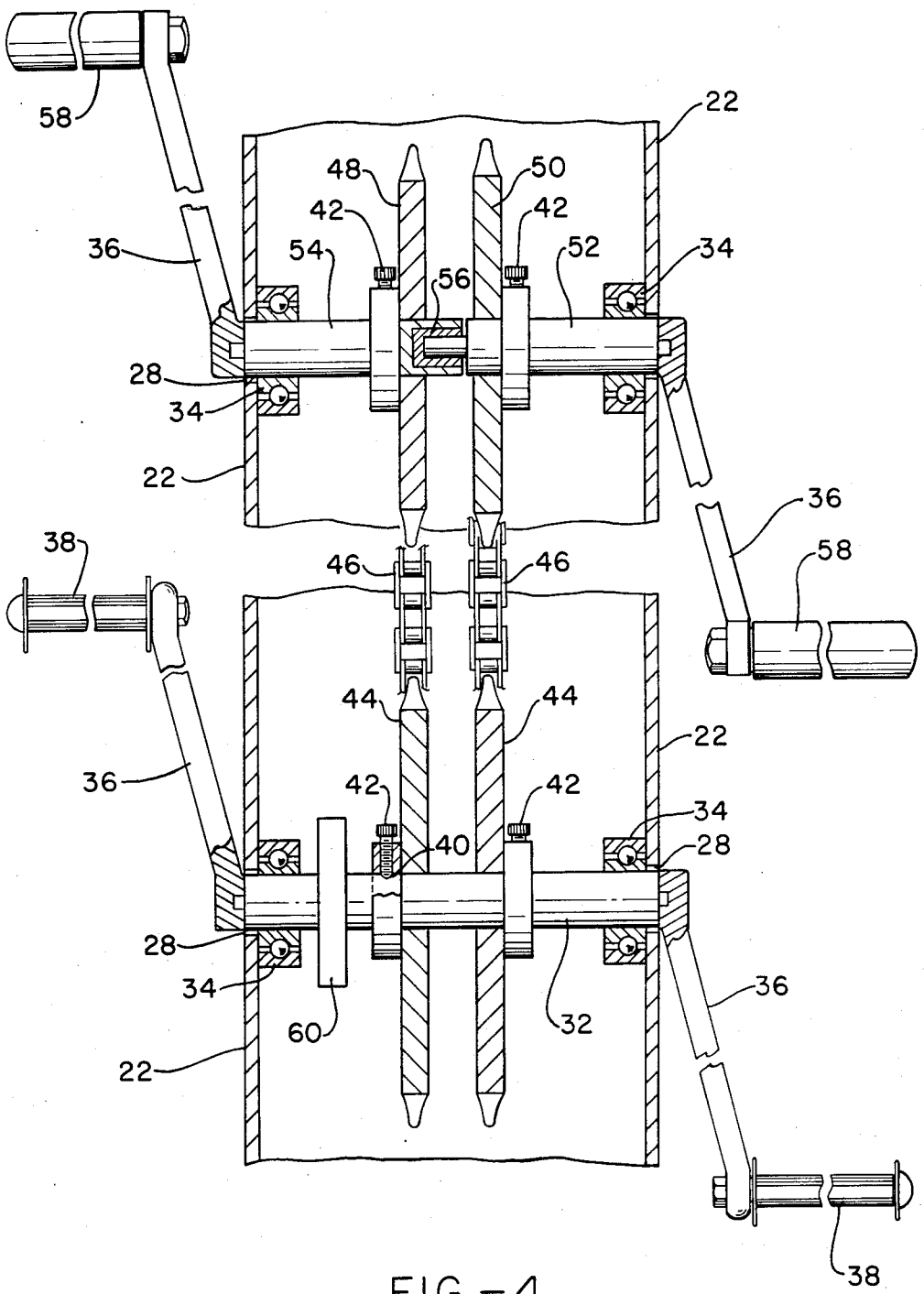
FIG. 4 is a cross-sectional view of the operative components taken along lines 4—4 of FIG. 1.

The forward column 22 is angularly affixed by means of welding or bolting to the tubular framework of the base 12. The forward column 22 is a U-shape and cover forming a square tube equipped with an upper pair and lower pair of holes 28 for receiving upper shafts 52 and 54 and lower shaft 32. As best seen in FIG. 4, the shafts are supported in the column 22 by ball-bearing blocks 34 fastened to the column 22 in some appropriate way such as by screw or welding place. The lower foot pedal shaft 32 has keyed and tapped ends for fastening opposed crank arms 36 at opposite ends of the shaft, said crank arms being drilled and slotted for fastening by means of screws (not shown) to the shaft ends. A pair of bicycle type foot pedals 38 are rotatably attached to the crank arm end.

The lower shaft 32 is equipped with set screw recesses 40 for attachment by means of set screws 42 of a pair of twenty-five (25) tooth sprockets 44, each equipped with a chain 46 connecting to a split portion of an upper shaft driven by the hand crank.

Said upper shaft is split into a male portion 52 and a female portion 54, the female portion having a bored hole at one end equipped with a press fit bushing 56 for receipt of a journalized end of the male shaft portion 52 whereby said shaft portions are interconnected for support but are independently rotatable one from the other. Each is rotatably supported through the column 22 by means of ball bearing blocks 34. The outward ends of the split shaft portions 52 and 54 are likewise keyed and drilled and tapped for receipt of crank arms 36, likewise having their fastening ends slotted and drilled for attachment to the shaft end. Each crank arm is equipped at the end with a rotatable handle 58. Each split shaft portion has a bored recess 40 for fastening by means of set screws 42 of a sprocket to each of said shaft portions. The male shaft portion 52 is equipped with a twenty-six (26) tooth sprocket 50 and the female shaft portion is equipped with a twenty-four (24) tooth sprocket 48 suitably aligned with a lower shaft sprocket 44, having twenty-five (25) teeth. Note the number of teeth ratios can vary and still meet the objects of the invention, so long as a difference in the number of teeth.

The chains 46 driveably interconnect the upper and lower sprockets whereby rotation of the lower shaft 32 turns the lower sprockets one revolution whereby sprocket 48 on the female shaft portion 54 is turned 1-1/24 revolutions and the 26 tooth sprocket 50 on the male shaft portion 52 is turned 25/26 of a revolution.

Figure 5:
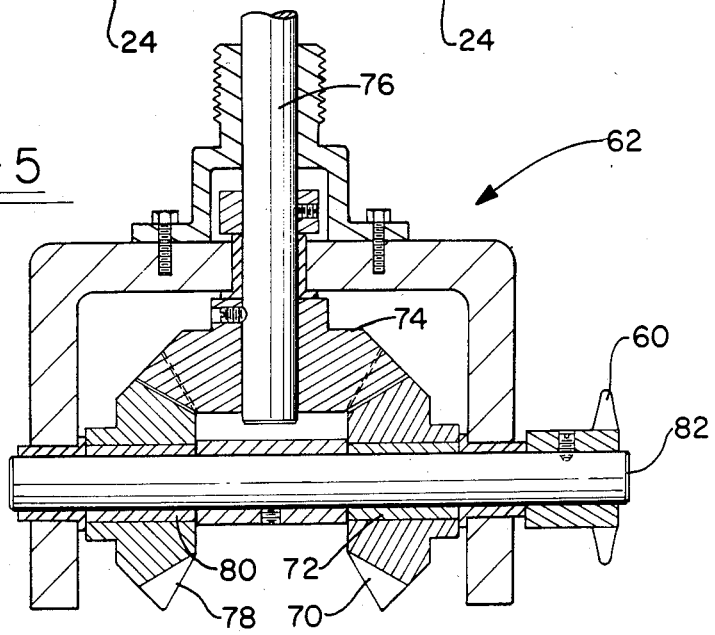
FIG. 5 is a cross-sectional view taken along lines 5—5 of FIG. 3, showing the single direction clutch speedometer drive adapter having dual directional input-single directional output assembly.

The therapeutic exercise device is equipped with a speedometer/odometer 66 mounted to the top of the column 22 driven by cable 64 from pickup gears 60 of the dual direction input, single direction output gear drive 62, shown in more detail in FIG. 5. The speedometer/odometer is operable even when the exercise device is pedaled in reverse, i.e., forward pedaling results in a speed and distance measurement which is continued even when the pedaling direction is reversed.

With reference to FIG. 5 of the drawings, the input shaft 82 of the dual direction input-single direction output is driven by chain from the lower or upper crank shaft output sprocket. The input shaft 82 turned in one direction drives bevel gear 70 through the single direction clutch 72 to drive bevel gear 74 and the output shaft 76 activating the speedometer. At this time bevel gear 78 and clutch 80 are free wheeling on input shaft 82.

When input shaft 82 driven in opposite direction, gear 78 is driven through clutch 80 which turns output shaft 76 and gear 74 in the same direction as with opposite direction input above. At this time, gear 70 and clutch 72 are free wheeling on input shaft 82. Thus results a dual direction input-single direction output speedometer drive for either forward or reverse pedaling on the exercising device.

The device, in operation, provides a user with unique and unexpected results and substantial therapeutic health benefits. As the device is operated, a rhythmic pedaling of the feet operating in opposed unison creates a relaxed rhythm to the lower body movement. The right arm operated in an independent cycle gradually falling out of phase with the feet, whereas the left arm, also operating in an independent cycle, moves somewhat faster than the turning movement of the feet. What occurs to the user is a natural inclination to sit up very straight in the seat and to fall into the predominant rhythm of the legs. Once any initial struggling with the out-of-phase arm movements is ceased, the user finds a sense of relaxed comfort and unusual movements of the upper body independent of the lower body. A very gentle and undulating complex twist of the spine, neck and shoulders loosens and tones up these areas of the body in a way very unlike ordinary cycle type movements. Equal time spent in reverse pedaling also seems to provide the most desirable relaxing and strengthening effects of the device.

It is further believed that the out-of-synchronous movement of the arms to the legs and torso more accurately reflects the normal nonsynchronous athletic movements of nearly every sport except running, swimming or rowing, thus making a workout on the apparatus of the invention more realistic to a normal workout in any of the nonsynchronous sports.

Further, while it is common in the prior art exercise bicycles to provide some type of loading adjustment, I have found that may not be necessary for my device, because the partial nonsynchronous movement, more similar to normal sporting movement, provides an excellent workout without loading. However, a brake to apply loading will be incorporated for those desiring an applied load for a more vigorous workout.

While in accordance with the patent statutes only the best mode and preferred embodiment of the invention has been illustrated and described in detail, it is to be understood that the invention is not limited thereto or thereby, but that the scope of the invention is defined by the appended claims.

What is claimed is:

1. An exercise device of the type having a base, a raised seat connected to the base, and a pair of hand cranks and a pair of foot cranks rotatably mounted on support means connected to the base, and comprising:

a shaft, a double sprocket mounted on said shaft, said foot cranks being operably connected to said shaft and fixed in their position relative to each other, a separate shaft for each handcrank, each carrying a single sprocket, said handcrank shaft sprockets being of different diameters; and a drive means interconnecting each handcrank sprocket to one of the double sprockets said device producing equal angular velocity in each of the foot pedals, and different angular velocities in each of the handcranks, and said device having the capability of being pedalled in reverse.

2. An exercise device according to claim 1, wherein said double sprockets each have 25 teeth, one handcrank sprocket has 26 teeth and the other handcrank sprocket has 24 teeth, and chain means interconnect the sprockets.

3. An exercise device, according to claim 1, which includes a speedometer means, a dual direction input single direction output drive means connected to said foot crank shaft to drive the speedometer means in one rotational direction when the exercise device is cranked in any direction.

4. An exercise device, according to claim 3, wherein said base is equipped with casters at the foward end thereof to carry the base when tipped forward.

* * * * *